United States Patent [19]

Capy et al.

[11] Patent Number: 4,989,875

[45] Date of Patent: Feb. 5, 1991

[54] DICE HAVING EIGHT FACES AND PROCESS OF PRODUCING SAME

[75] Inventors: Gilbert Capy, La Botte, Jarnioux, F-69640 Denice; Jacques Benarrouch, Caluire-et-Cuire, both of France

[73] Assignee: Gilbert Capy, Denice, France

[21] Appl. No.: 301,610

[22] Filed: Jan. 26, 1989

[30] Foreign Application Priority Data

| | | | |
|---|---|---|---|
| Feb. 2, 1988 | [FR] | France | 88-01470 |
| Jul. 12, 1988 | [FR] | France | 88-09704 |
| Aug. 26, 1988 | [FR] | France | 88-11426 |

[51] Int. Cl.[5] ..... A63F 9/04

[52] U.S. Cl. ..... 273/146; 273/138 R

[58] Field of Search ..... 273/146; D21/41

[56] References Cited

U.S. PATENT DOCUMENTS

| | | | |
|---|---|---|---|
| D. 25,701 | 6/1896 | Patten | 273/146 X |
| 614,524 | 11/1898 | Yardley | 273/146 |
| 3,399,897 | 9/1968 | Mitchell | 273/146 |
| 4,436,306 | 3/1984 | Sanders | 273/146 |

FOREIGN PATENT DOCUMENTS

| | | | |
|---|---|---|---|
| 277658 | 8/1988 | European Pat. Off. | 273/146 |

*Primary Examiner*—Edward M. Coven
*Assistant Examiner*—Raleigh W. Chiu
*Attorney, Agent, or Firm*—Sandler, Greenblum & Bernstein

[57] ABSTRACT

Die containing eight planar hexagonal surfaces and six convex portions capable of producing random results when thrown. The convex faces are dimensioned so as to constitute areas of unstable equilibrium to favor positioning of the die on one of the hexagonal surfaces when so thrown. The die can be marked with card values and suits associated with a deck of playing cards whereby a set containing the marked dice can be utilized to play poker card games. Moreover, the card values and suits can be positioned on the dice so that marking of the dice can be performed in a two pass printing process.

28 Claims, 4 Drawing Sheets

DICE HAVING EIGHT FACES AND PROCESS OF PRODUCING SAME

BACKGROUND OF THE INVENTION

1. Field of the Invention

The invention relates to a die having eight planar surfaces and six convex surfaces. The eight planar surfaces can be marked with various symbols, and preferably include the card values and color symbols or suits associated with a deck of cards. The die can be utilized alone, or in combination with other dice, for parlor games. With a set of dice having eight planar surfaces marked with all or a portion of the card values and suits of a deck of fifty-two cards, it is possible to obtain various card combinations. In this regard, a die having eight planar faces according to the present invention can be packaged in sets of, for example, two, three, four, five, six or seven dice. Such sets of dice render it possible to play games wherein by a simple roll of the dice at least some, and preferably all poker hands may be obtained. For example, it is possible to obtain a combination of consecutive card values in the same suit, conventionally known as a straight flush.

2. Description of Pertinent Materials and Background

Dice are currently utilized in parlor games to randomly select a mark. A widely used die has six faces marked with one to six points and serves to obtain marks for a plethora of parlor games throughout the world. Dice are also known having six faces marked with card values including the ace, king, queen, jack, ten, and nine. These dice are especially utilized to play ace poker games, wherein five identical dice are used to obtain various combinations of card values.

In addition to the dice described above, there are also known dice having four and eight faces. Dice having eight faces are formed substantially of two pyramids having a common square base and faces in the form of equilateral triangles attached at their base. The faces of such dice are usually numbered from one to eight. Dice also exist having ten faces, twelve faces, and twenty faces. Unlike the dice having six faces which provide a guarantee of a certain level of credible randomness, the known dice having four, eight, and ten faces have angles between the faces and points which are too pronounced to achieve a sufficient roll in a manner so as to neutralize characteristics of the throw.

SUMMARY OF THE INVENTION

It is an object of the present invention provide a die that has eight planar faces that can randomly select one of the eight faces when the die is thrown.

The present invention achieves this objective by providing a die having eight planar faces and six convex faces, wherein the planar surfaces are substantially hexagonal and have sides substantially of a length A. Common sides of the hexagonal planar surfaces are tangent at their ends to a sphere having as a radius the length A of the side of the hexagon, constituting unstable equilibrium zones, in a manner so as to favor the positioning of the die on one of the planar surfaces.

In one embodiment of the invention it is possible to render the dice suitable to be used in games by the application of general rules to a set of dice. In this set of dice, each die has on each of its planar faces, both a card value and a color symbol representing one of the cards of a set of fifty-two cards with or without jokers. The eight planar surfaces constitute a particular combination of eight card values in a defined order, as well as a particular combination of four color symbols also in a defined order. Simultaneous throwing of all of the dice of the set makes it possible to obtain a variety of card hands, including hands having a series of cards which follow one another in the order of value defined and in the same color symbol and hands having a series of cards which follow in the order defined in color symbols which are systematically different.

In a further embodiment of the present invention, the set of dice includes from two to seven dice marked with values and color symbols of a set of fifty-two playing cards. The values and color symbols marked on the set of dice being equal to eight times the number of dice in the set, in the order of defined value of the cards. Each die in the set includes two blocks of four card values which follow in the order of defined value, with the first card value of the second block being obtained by counting a number of card values equal to the number of dice in the set from the first card value of the first block. Furthermore, each first card value in each first block of each die follows in the order of defined value the first card value of a first card value of the first block of the preceding die.

Moreover, with the eight card values on each die can be applied one of the four suits associated with a deck of playing cards in a defined order. More specifically, the order of application of the suits can alternate successively between a black color and a red color and from suit to suit; and the card values can be positioned on said planar faces in a manner such that the first card value of the first block is opposite the fourth card value of the second block, the second card value of the first block is opposite the third card value of the second block, the third card value of the first block is opposite the second card value of the second block, and the fourth card value of the first block is opposite the first card value of the second block. The card values are preferably positioned on each die in a manner such that two consecutive card values are not on faces having a common edge, and four card values of the same color on each die are grouped around a single convex face which allows for the printing of the die by stamping in two passes.

In still a further embodiment of the present invention, the set of dice can be held together by a molding core which serves as a connecting device during printing by stamping, so as to eliminate the risks of error associated with positioning.

The die according to the present invention can be produced by the process of machining two sets of parallel plane faces, spaced by about 2.446(A), on both sides of a center of symmetry O of a sphere, and having between said two sets of substantially parallel plane faces an angle of about 109.39°, with the apices thereof forming intersection edges. The sphere is then rotated substantially 90° around an axis that passes through the center of symmetry O and that is perpendicular to a plane passing through the intersection edges. Then two further sets of substantially parallel plane faces, spaced by about 2.446(A), are machined on both sides of the center of symmetry O at an angle of about 109.39° to each other, with the apices thereof forming intersection edges.

In another manner of defining the present invention, a die is provided which has eight planar faces and six convex faces. The planar surfaces include substantially regular hexagonal faces, with the hexagonal faces being grouped in a first block and a second block. Each of the two blocks contains four hexagonal faces, with each hexagonal face in each block having two sides in common with the other hexagonal faces in the block to thereby define four common edges and a substantially pyramidal shape having a base including a third side of each hexagonal face. The two blocks are positioned relative to one another so that the base of the first block is coextensive with the base of the second block, and the third sides of the hexagonal faces in the two coextensive bases form four common edges. The sides of the hexagonal faces that are not in common with sides of the other hexagonal faces forming six zones, and a convex face is located in each zone. The convex faces are dimensioned so as to constitute areas of unstable equilibrium to favor positioning of the die on one of the hexagonal faces. A plurality of these dice, such as, for example, two to seven dice, can be provided in a set.

The convex faces can be provided with surfaces that are substantially tangent to each of the common edges, and can comprise a portion of a sphere having a radius of approximately the length of a side A.

Apices are defined by end portions of the common edges, and the convex faces can extend past an imaginary sphere that has at its center a center of symmetry O of the die and passes through said apices. The radius of this imaginary sphere is preferably about 1.581(A).

As previously discussed, the die can include markings, such as numbers or symbols, or both. These markings can constitute card values and color symbols (suits) associated with a deck of playing cards.

In still another embodiment of the present invention, a process for producing a die having eight planar faces having sides of substantially a length A and six convex faces is provided. This process includes the steps of providing a sphere having a center of symmetry O; machining a first set of substantially parallel planar surfaces on both sides of the center of symmetry; machining a second set of substantially planar surfaces, on both sides of the center of symmetry, at an angle to the first set of substantially parallel planar surfaces forming two intersecting edges; rotating the sphere substantially 90° around an axis that passes through the center of symmetry and is perpendicular to a plane passing through said two intersection edges; machining a third set of substantially parallel planar surfaces on both sides of the center of symmetry; and machining a fourth set of substantially planar surfaces, on both sides of the center of symmetry, at an angle to the third set of substantially parallel planar surfaces; and forming six convex faces at apices formed between the four sets of planar surfaces to thereby obtain a die having eight planar faces and six convex faces. The convex faces are then dimensioned so as to constitute areas of unstable equilibrium to favor positioning of the die on one of the planar faces.

In this process, the substantially parallel planar surfaces in each set of substantially parallel planar surfaces are preferably spaced apart approximately 2.446(A). Moreover, the angle between the first and second sets of substantially parallel planar surfaces and the third and fourth sets of substantially parallel planar surfaces is about 109.39°. Also, the sphere preferably has a radius of at least 1.707(A), and more preferably equal to about 1.707(A).

The process of producing the die can include the step of marking the die with the various marked discussed herein, such as markings associated with playing cards. These markings can be placed on the die by a two pass printing process.

Furthermore, the present invention is directed to dice produced by the processes discussed herein.

BRIEF DESCRIPTION OF THE DRAWING

The present invention will now be described with reference to non-limiting examples demonstrating various embodiments thereof, with reference to the annexed drawings, in which.

DETAILED DESCRIPTION

The die forming an object of the invention allows for random results, and consequently can be utilized for card games, such as poker, or for lotteries. In general, there are utilized a plurality of dice marked with card values and color symbols or suits associated with a deck of playing cards. These dice are thrown simultaneously or one after another so as to obtain card combinations. Because conventional card games are composed of four suits, dice having eight surfaces are particularly suitable in view of the fact that such dice have a number of surfaces which are a multiple of four. While dice having four and twelve faces also constitute a multiple of four, the number of faces on four-faced dice are not sufficient, and the number of faces on twelve-faced dice are excessive.

In describing the invention, there will first be defined the manner of achieving a die having eight planar faces, followed by a description of the distribution of the cards, as a function of the number of dice utilized in the game, so as to obtain the hands of a poker game. Moreover, there will be discussed the manner of making the die according to the invention, as well as the manner of providing markings on the planar surfaces.

Figure 1:
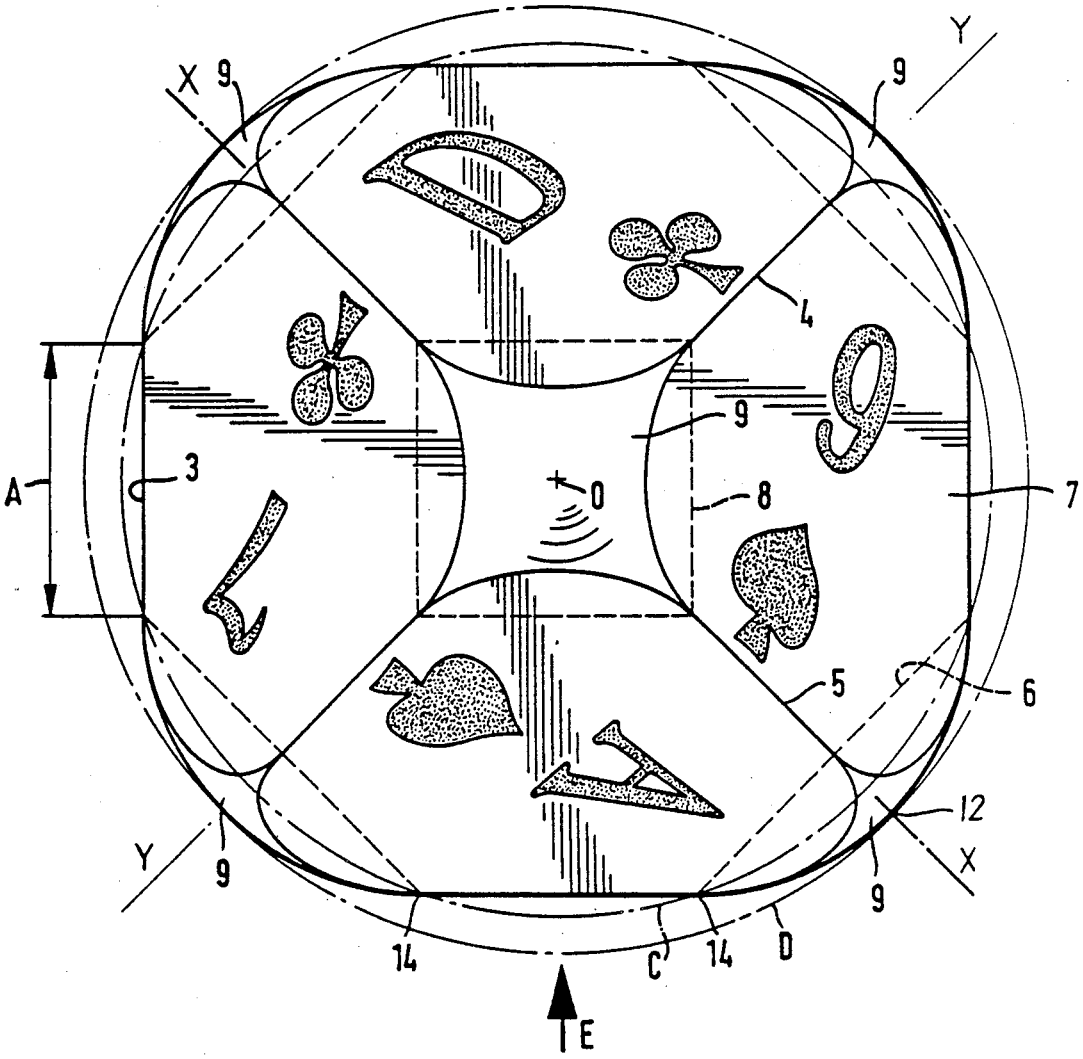
FIG. 1 illustrates a view of a die according to the invention with the plane C being parallel to the sheet of drawing.

FIG. 1 illustrates a die according to the invention, which die is composed of an assembly of eight regular identical hexagonal faces 7, having a length A on each side. The hexagonal faces shown in FIG. 1 each have in common with the hexagonal faces not shown in FIG. 1 a common side 3. For example, the common side 3 for the hexagonal faces marked with the "ace of spades" and the "eight of diamonds" is illustrated in FIG. 2.

Figure 2:
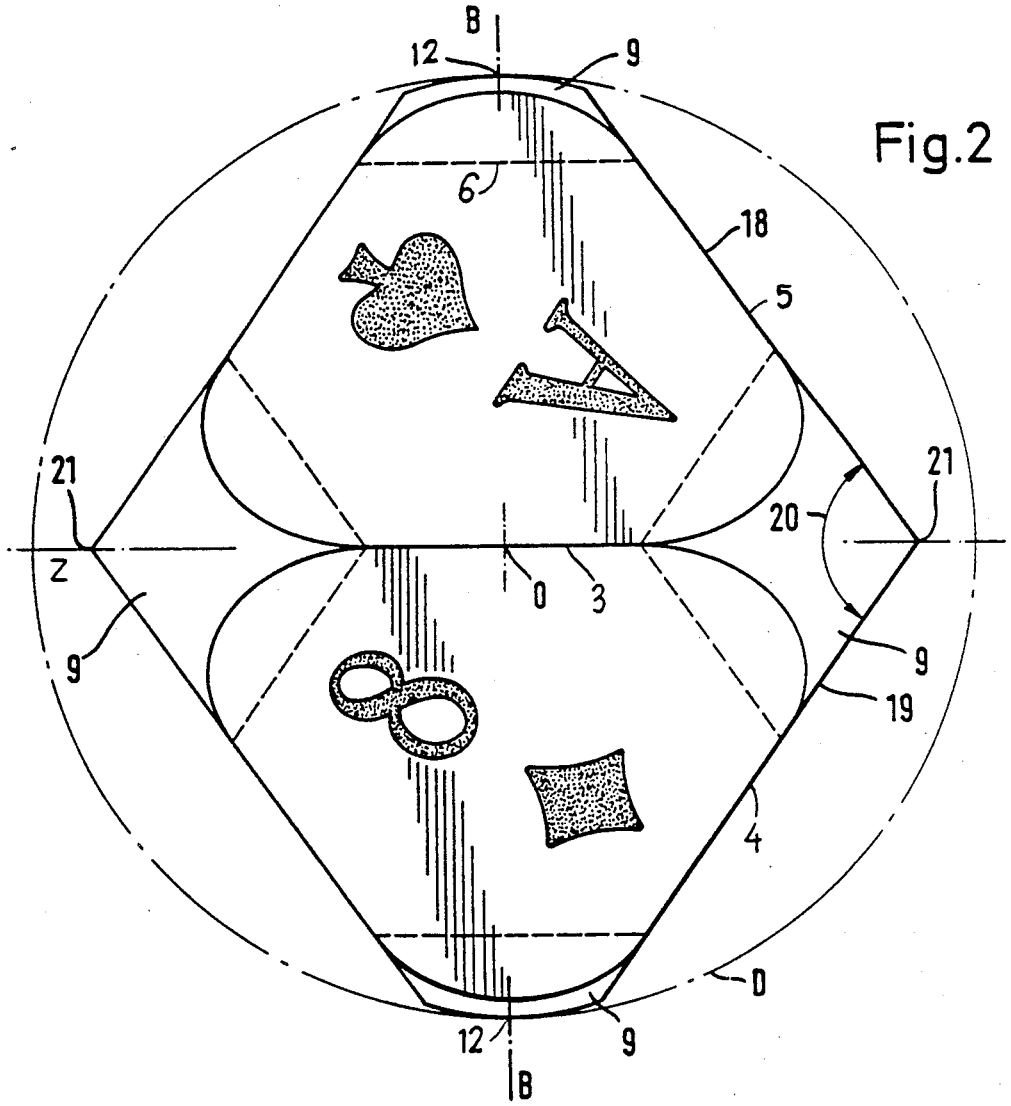
FIG. 2 illustrates a view of a die according to the invention along the direction "E" indicated in FIG. 1, and in a partial state of manufacture.

As can be most easily observed in FIG. 2, the hexagonal faces 7 are shown in the form of three sides in solid lines numbered 3, 4 and 5, and three sides in dashed lines numbered 6. Each of the hexagonal faces 7 has a side 4 in common with a side 5 of another hexagonal face, and, as previously indicated, a side 3 in common with a side 3 of another hexagonal face. Sides 6 constitute the sides of square surfaces 8 bordered by four hexagonal faces 7, which are connected to one another as described above. The apices 14 constitute the apices of both the hexagonal faces 7 and the square surfaces 8. The die thus formed comprises eight hexagonal faces 7 and six square surfaces 8 of smaller surface area, and having a length that is equal to the length A.

Further, as shown in the drawing, three mutually orthogonal planes X, Y and Z, each being perpendicular to each other, pass through the die. As shown in FIG. 1, planes X and Y are perpendicular to each other and to the sheet of drawing, while plane Z is parallel to the sheet of drawing. As shown in FIG. 2, plane Z is vertically oriented, and perpendicular to the sheet of drawing.

The square faces 8, if planar, can constitute stable support zones for the die. In this case, it is not possible to guarantee with any degree of certainty that a throw of the die will select a hexagonal face. Generally, when a hexagonal face cannot be selected, the dice must be rethrown. For the convenience of the player, it would be desirable to reduce the chances of such a possibility occurring. To obtain a reduced chance of the necessity of having to rethrow the dice, it is sufficient to construct convex surfaces 9 within the boundary of the square faces 8, with the edges of convex surfaces 9 constituting the edges of the square faces 8. A perpendicular formed by the crossing of two of the mutually perpendicular planes X, Y, and Z passing through each of the square faces 8 and each of the convex surfaces 9 constitutes the axis of symmetry of each square face 8 and convex surface 9. An apex 12 is formed at the meeting point between the axis of symmetry and the convex surface 9. This axis of symmetry is also an axis of symmetry for the die. The curvature of the convex surface 9 can be continuous or discontinuous, and may include planar portions. It is important that the apex 12 constitute an unstable equilibrium point.

The geometrical center or barycenter O of the die, which die is considered as an homogeneous volume, is preferably at the meeting point of the three planes X, Y and Z. The geometrical center O is also the center of the circumscribed sphere C that passes through the apices 14, which constitute the apices of both the hexagonal faces 7 and the square faces 8. The surface of the circumscribed sphere C passing through the apices 14 constitutes a neutral shape where each point is an equilibrium point, and this surface separates two large zones that on the one hand contribute to stable equilibrium of the die and on the other hand to unstable equilibrium of the die. More specifically, this sphere C, whose radius is equal to 1.581*(A), can cut the three mutually orthogonal planes X, Y and Z at a point that is exterior to the die, if the convex surface 9 is slightly convex, or at a point within the die if the convex surface 9 is very convex. In the situation wherein the sphere C cuts the three planes at a location that is exterior to the die, a zone of stable equilibrium is obtained because slight movement of the die from its equilibrium position at the apex 12 of the convex surface 9 creates a restoring force which tends to bring the die back to the apex. In the situation wherein the sphere C cuts the three planes at a location that is interior of the die, a zone of unstable equilibrium is obtained because the moving of the die from its equilibrium position accelerates the disequilibrium by creating a torque tending to move the point of application of the weight from the equilibrium position.

In this regard, every convex surface 9 passing through the apices 14 and cutting the X, Y or Z planes exteriorly of the circumscribed sphere C is capable of providing a die that would be acceptable. However, an additional constraint must be addressed; namely, that a zone of stability can be obtained by creating, for example, at the apex 12 of the convex surface 9 a flattened zone perpendicular to the two planes passing therethrough. To avoid this problem, it is necessary that the radius of curvature at the apex 12, and areas adjacent thereto be less than the radius of the sphere D centered at the barycenter O of the die and passing through the apex 12.

In a preferred version of the invention, a portion of the sphere passing through the apices 14 and tangent to the common sides of the hexagonal faces 7 leading to the apices 14 forms the convex surface 9. In particular, there exists a sphere 9 whose radius is equal to the length A of the side of the hexagonal faces, and whose surface is tangent to the common sides, with the points of contact of the sphere with the common sides being the apices 14.

Figure 3:
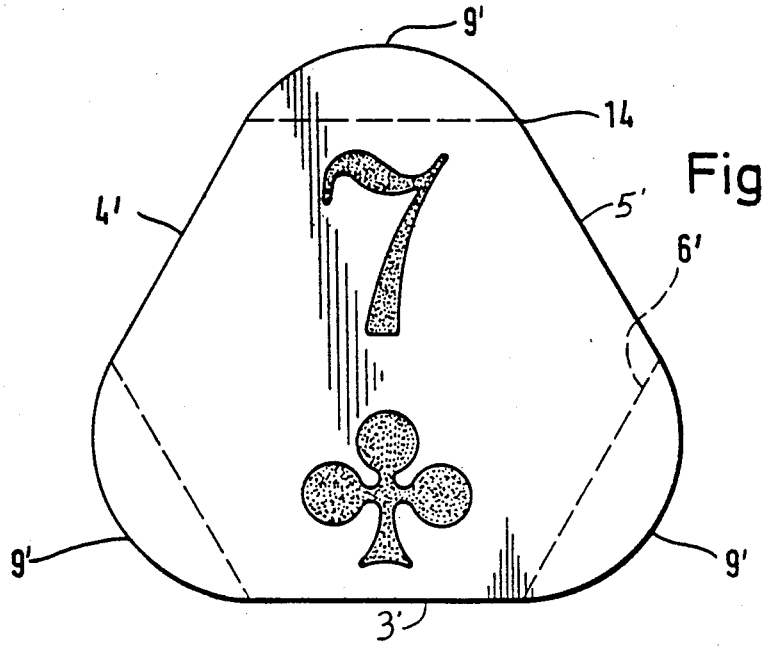
FIG. 3 illustrates one of the planar faces of the die according to another embodiment of the invention.

This solution has been selected because it makes possible a good continuity between the sides 3, 4 and 5 of the hexagonal faces and the convex surface 9. If the radius is greater than A, while still conforming with the previously described conditions, there is obtained a discontinuity which is not very esthetic, but which functions acceptably. If the radius is less than A, there is obtained an unacceptable projection that does not follow the lines of the dice because this sphere cannot contain sides 6 of a square surface 8. Therefore, each hexagonal face 7 must be modified until it intersects with the convex surface 9 situated within the square surface 8. The hexagon of FIG. 3 then becomes a surface comprising apices 14' which are disposed in the form of a regular hexagon, whose sides are formed by segments 3', 4', 5', and 6', and also includes arcs 9'. While the radius of the sphere 9 in FIG. 1 is equal to A, the radius of the arc 9' in FIG. 3 is equal to 0.577(A).

Discussed above are the ideal dimensions for defining a die having eight faces. It is of course clear that variations of at least 3–5% with respect to these ideal dimensions would not go outside the present invention. To this extent, it is noted that this element is not a precision element, and it is natural to take into account such differences that would make it possible to reduce the cost of manufacture.

The manufacture of a die begins in all cases with the cutting of a piece of material to the definitive sides which will ultimately serve to form the die, either directly or with molds. For this reason, there will be defined all of the parameters which make it possible to obtain a mother shape by a simple machining method. By way of example, according to the preferred embodiment described above, a preferred parameter is the length A of a side of hexagonal face 7.

The minimum volume to be utilized to machine this die is the sphere D of radius equal to 1.707(A) passing through the apices 12 of convex surfaces 9. If O is the center of this sphere D, two planar parallel symmetrical surfaces 18 spaced a distance of substantially 2.446(A) are first machined with respect to O. Then two other planar parallel planes 19, symmetrical with respect to O, and spaced a distance of substantially 2.446(A), and making an angle 20 of 109.39° with the two planes 18 are machined. At this point, as illustrated in FIG. 2, there are obtained two edges of intersection 21. The last four surfaces are obtained by rotating the machined sphere 90° around an axis B passing through O and perpendicular to a plane passing through the edges of intersection 21, for example, plane Z in FIG. 2, and machining the four last surfaces in a similar manner to the first four surfaces.

Further, as illustrated in FIG. 2, it is then necessary to machine the convex surfaces 9. As previously stated, such convex surfaces 9 are preferably portions of a sphere having a radius A, and are obtained by machining the initial sphere D of radius equal to 1.707(A) to the apices 12.

At the conclusion of these machining steps, there is obtained the die shown in FIG. 1, formed with eight hexagonal faces having sides of length A. The edges 4', 5', and 6', and the arcs 9', as shown in FIG. 3, can be rounded to avoid the introduction of anomalies associated with irregular wear. Further, while dimensions have been described which yield ideal proportions, it is evident that a variation of several percent from these dimensions will not necessarily interfere with the function of the die.

The die according to the invention can be manufactured in a different manner, as by injection of plastic material into a mold. In this method, the plastic material can be injected into a mold constituted by two symmetrical hollow portions having one of the mutually perpendicular planes as a common axis.

The eight hexagonal faces can each comprise a card value and a suit or color symbol of a playing card of a conventional fifty-two card poker deck. Specifically, this set of cards comprises the four well known suits, spades, clubs, diamonds and hearts, which appear in two colors, black and red. Each suit comprises thirteen cards having values which range from the ace to the deuce. Because the distribution is directly dependent on the set that one wishes to obtain, these cards are not randomly positioned on the hexagonal faces of the dice. In particular, in a preferred version of the invention, the designation of the values and suits flows from a general principal making it possible to obtain various sets of dice, such as sets containing two, three, four, five, six or seven dice, which are printed with two printing passages. Of course, the number of cards to be employed in a game depends on the number of dice in the set, and the number of cards in a game should preferably be limited to a multiple of eight cards obtained by multiplying by eight the number of dice selected.

It is not possible with a set containing two, three, or four dice to obtain all of the hands of poker, particularly those hands requiring five cards, such as the full house. A set of seven dice, comprising fifty-two cards and four jokers, overcomes this disadvantage but this requires the presence of four jokers. This has the disadvantage in that one must throw seven dice and determine the proper combination of five faces by selecting five of the seven thrown faces. Such necessity of selecting five cards distances the game from the spirit of conventional poker games that are based on the presence of only five cards in one's hand.

Based on this disadvantage, the idea originates to select a number of dice which does not require the use of jokers, and which includes a minimum of five dice. When five dice are utilized, only forty faces are present, and cards below "five" must be eliminated. When six dice are utilized only forty-eight faces are present, and cards below "three" must be eliminated. Whether or not there may be a commercial interest, it is noted that, by following the same principles, various games can be obtained utilizing a number of dice less than five (comprising, for example, sixteen, twenty-four, or thirty-two faces) or greater than seven dice. To facilitate understanding of the invention, the examples describe below primarily refer to a set of five dice, but the rules established with respect to these examples are applicable to all games comprising a different number of dice.

Figure 4C:
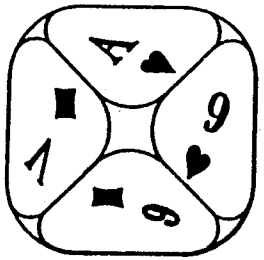
FIGS. 4–8, indices C and D, illustrate a set of five dice according to the invention comprising forty cards.
Figure 5C:
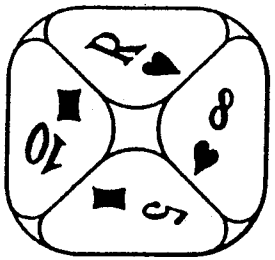

The figures numbered 4–8, with indices "C" and "D", each represent one die of a set of five dice according to the invention. Card values are shown by letters or numbers, utilizing, for example, "A" for the ace, "R" for the king, "D" for the queen, "V" for the jack, "10" for the ten, etc. The figures marked with the index "C" represent the faces marked with values and red symbols associated with hearts and diamonds; and the figures marked with index "D" represent the faces marked with values and black symbols associated with spades and clubs. Furthermore, the opposite faces of a same die occupy the same place on the figure comprising the index "C" and on the figure comprising the index "D". For example, the "ace of hearts" of FIG. 4C is opposite to the "queen of spades" of FIG. 4D.

Before placing the cards on a set of dice to obtain desired results as a function of the number of dice, it is necessary first to define the order of the value of the cards. The examples described below utilize the order of a set of fifty-two cards that begins with the ace, followed by the king, and so on until the deuce. For a set having seven dice, jokers are added. These jokers can be placed in various positions, and can, for example, be placed after the deuce. For a set having five dice, the same order is utilized; however, a set of five dice includes forty faces so only the ace through the five are utilized to thereby obtain a set of five dice representing forty cards. Similarly, for a set having six dice, only the "ace" through the "three" are utilized to provide a set of six dice representing forty-eight cards. In the same manner, there can be determined the cards to be preserved in the case of a set having four, three or two dice by stopping respectfully at the "seven", at the "nine", and at the "jack".

As noted above, each card has a value, such as the "king", and a suit or color symbol, such as the "spade". Card values are preferably considered in decreasing order and a series continues when one has reached the lowest card value in one suit and continues with the highest card value in another suit, and again by considering the card values in that suit in decreasing order. By way of example, for a set having five dice, the card values go from the "ace" to the "five" in one suit, and then continues with the "ace" of another suit, followed by the "king", and so on.

Figure 7C:
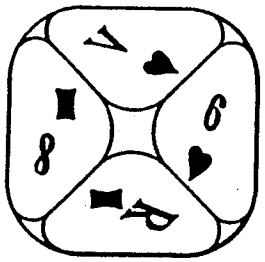
Figure 7D:
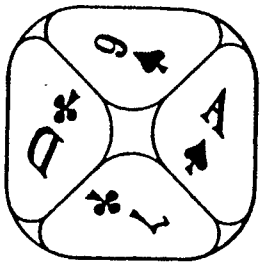

Not only must the order of placing of cards on the faces of the dice be ascertained, but the cards must in some manner be marked on these faces. One manner of accomplishing this task is to select to print, on each die, two blocks containing four card values each on each die. The four card values in each block are selected as consecutively decreasing values, with the first card value of the second block of four card values being obtained by counting in decreasing order from the highest card value in the first block as many card values as there are dice in the set. By way of example, in the situation where there are five dice, if the first card value of the first die is an "ace", as illustrated in FIGS. 7C and 7D, the first block of four card values includes the "ace, king, queen, and jack", and the first card value of the second block is obtained by counting five cards from the "ace"; namely, "king, queen, jack, ten, and nine". Accordingly, the second block is composed of the four card values "nine, eight, seven, and six".

Figure 4D:
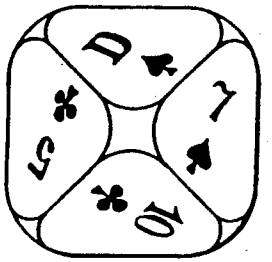
Figure 5D:
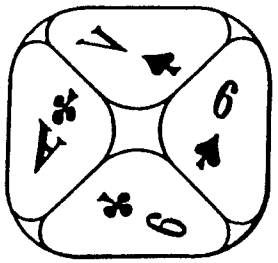

The first card value of the first block of the second die is obtained by selecting the card value which follows in value the card value of the first block of the preceding die. By way of example, since as discussed above the first block of the first die commences with an ace, the first block of four card values of the second die commences with a king, the first block of the third die commences with a queen, the first block of the fourth die commences with a jack, and the first block the fifth die commences with a ten. Consequently, in the illustrated example, the first block of the third die, as shown in FIGS. 4C and 4D, which begins with the "queen" includes "queen, jack, ten, and nine", and its second block of four card values, counting five cards from the "queen" includes "seven, six, five, and ace". One continues like this until the fifth die, illustrated FIGS. 6C and 6D, which includes, as its first block, "ten, nine, eight, seven", and, as its second block, "five, ace, king, and queen".

Figure 6C:
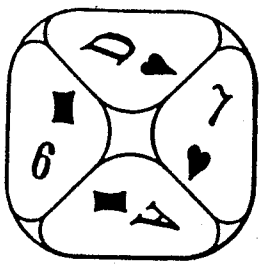
Figure 8C:
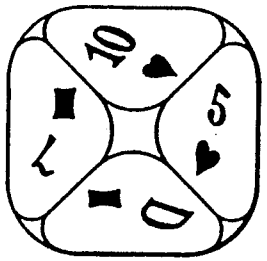
Figure 6D:
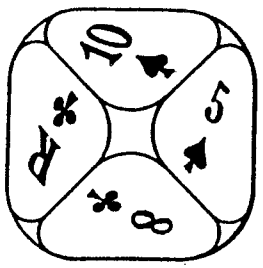
Figure 8D:
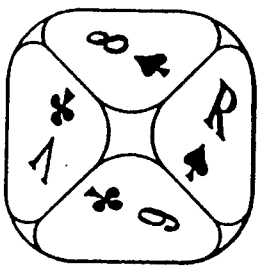

When one applies the card values to each die, one also applies the suit or symbol. It suffices to define an order for the four suits and to apply the suits in this order, without modification, to each block of four cards. In a preferred embodiment of the invention, one proceeds by alternating between the black and red suits in a defined order, such as, for example, spade, diamond, club, heart, and maintaining this defined order for the entire set. The reason for this choice is that it renders more economical the manufacture of the dice. It is evident that one can select another order, but the cost of marking will be higher. The application of this rule yields for the first die of the five dice set, as illustrated in FIGS. 7C and 7D, "ace of spades", "king of diamonds", "queen of clubs", "jack of hearts", "nine of spades", "eight of diamonds", "seven of clubs", and "six of hearts". The second die, as illustrated in FIGS. 8C and 8D, begins with the "king of spades", the third die, as illustrated in FIGS. 4C and 4D, begins with the "queen of spades", and so on until the last die, as illustrated in FIGS. 6C and 6D, begins with the "ten of spades". Equivalent results may be obtained if the order is reversed, for example, by reversing the spades with the clubs, or the diamonds with the hearts. Moreover, the order can first be defined with a red suit instead of a black suit. Of course, the cards will be differently positioned on the dice, but the same results will be obtained.

Finally, on each die, the faces need to be positioned with respect to one another. To accomplish this task, it suffices to create four card value couples between the first and second blocks. Specifically, the first card value of the first block and the fourth of the second block for the first couple and the second of the first block and the third of the second block for the second couple and so on until the fourth couple. By way of example, this gives for the first die (FIGS. 7C and 7D) of the set having five dice the following couples: ace of spades and six of hearts, king of clubs and seven of diamonds, queen of diamonds and eight of clubs, jack of hearts and nine of spades. Preferably, after the couples are created, they are applied to the hexagonal faces of each die such that cards of values which follow each other are not situated on hexagonal faces having a side of the hexagon in common.

Figure 9C:
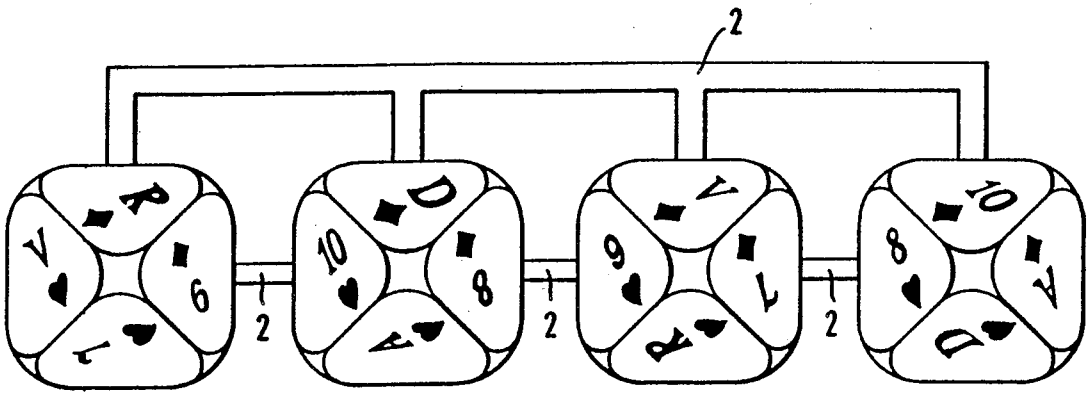
FIG. 9, indices C and D, illustrate a cluster of dice according to the invention constituting a set of four dice forming thirty-two cards.
Figure 9D:
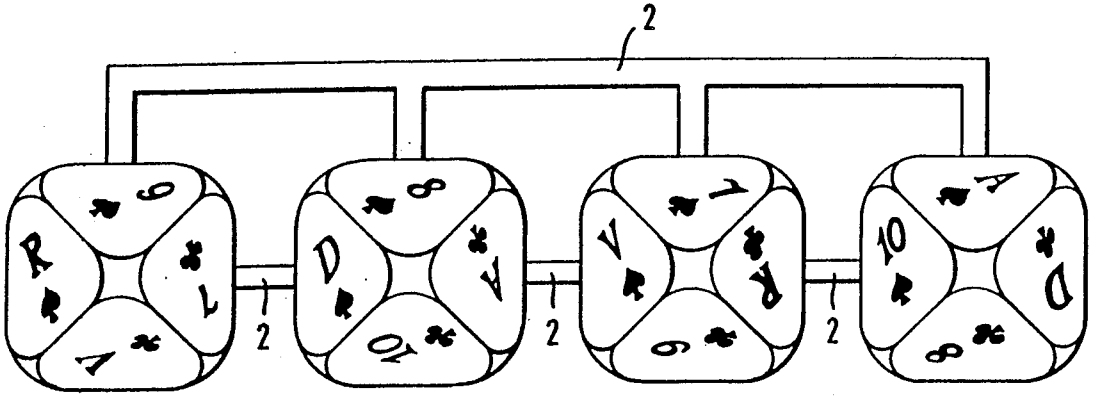

Under the circumstances as illustrated in FIGS. 4–8, four faces of the same color are grouped around a single curved face. Such positioning of cards of a single color around a single curved face permits, in a situation wherein only two colors are present, the printing by stamping of the die in two passes. To avoid any risk of error in positioning of the dice for printing purposes, the dice can be attached to each other in a cluster, as illustrated in FIGS. 9C and 9D. Through the use of such a two pass printing technique, there can be obtained by the throw of the dice a series of cards, which series is equal to the number of dice thrown, of consecutive card values of the same color. For example, as indicated by the "straight flush" in hearts illustrated in FIGS. 4C through 8C, a "straight flush" can be thrown using a set of five dice. Of course, other rules of positioning of card values and suits on the faces can be adopted, but the manufacture of the dice may be complicated and the risk of error would increase. Furthermore, the decoration of the dice can be varied by utilizing other colors than black and red without modifying the principles of the invention.

The marking of the faces can occur by any of the printing processes available on the market. For example, the printing technique utilizing sublimation can be employed. The sublimation printing technique allows for a marking of the material in depth while permitting a plurality of colors per face, but presents a problem in that it is difficult to print a plurality of faces at the same time by this technique. Accordingly, substantial costs of printing may be associated with the sublimation printing technique.

As was previously noted, it is possible to economically mark the dice by utilizing a stamping printing technique. This technique consists of pressing a preinked stamp made out of flexible silicone onto a die in an orientation that is parallel to one of the three orthogonal planes passing through the center of the die. By utilizing this stamping technique, four of the hexagonal faces can be simultaneously printed. For example, for the first die of the set illustrated in FIG. 7D, the "ace of spades", the "queen of clubs", the "nine of spades", and the "seven of clubs" are four black cards that can be printed at the same time. After printing the black suits, a stamp preinked with a different color is utilized to print the four remaining hexagonal faces on the remaining die or dice. In the illustrated example, as shown in FIG. 7C, the four red cards that are printed at this time are the "six of hearts", the "eight of diamonds", the "jack of hearts", and the "king of diamonds". Accordingly, in two passes, the eight hexagonal faces can be marked. These two passes can be taken advantage of to mark the curved faces that are at the center of a group of four hexagonal faces, but there is a risk of obtaining a poor quality of marking. It is preferable to make a new printing pass.

As illustrated in FIGS. 9C and 9D, to avoid printing problems associated with errors in positioning, it is desirable to maintain the dice connected to one another by the material 2 of the feed channels or mold cores of the mold during the printing process.

A stamping technique of printing makes it possible to limit the costs of machining of the dice, but does present a problem of retention of the marking due to friction on the hexagonal faces during use of the dice. However, nothing prevents using the conventional technique of manufacturing dice by engraving the dice. When the dice are engraved, extra precautions should be instituted to minimize the risk of errors in the course of manufacture associated with the use of several colors on a single die and associated with the fact that the dice in a single set are different.

By utilizing the same techniques, a set of thirty-two cards on four dice can be printed with one color per die. In this embodiment, there can be obtained, for example, a first die including all cards of the spade suit from the "ace of spades" until the "seven of spades", a second die including all of the cards of the heart suit, and so on. The other rules of application of the cards per face remain valid. This set makes it possible to reflect one card of each suit.

Although the invention has been described with reference to particular means, materials and embodiments, it is to be understood that the invention is not limited to the particulars disclosed and extends to all equivalents within the scope of the claims.

What is claimed is:

1. A die comprising eight planar faces and six convex faces, wherein said planar faces are substantially hexagonal having sides substantially of a length A and defining squares at their apices, said squares being occupied by said convex faces, said convex faces having apices extending past the surface of an imaginary sphere of radius 1.561(A) centered at the center of gravity of said die and passing through the apices of said squares, said convex faces further having a radius of curvature less than the radius of curvature of an imaginary sphere centered at the center of gravity of said die and passing through the apices of said convex faces, whereby said convex faces constitute unstable equilibrium zones, in a manner so as to favor the positioning of the die on one of the planar surfaces.

2. A set of dice comprising a plurality of dice according to claim 1, which set of dice render it possible, by application of general rules, for the dice to be used in games, each die within the set comprising, on each of its planar faces, both a card value and a color symbol representing one of the cards of a set of fifty-two cards with or without jokers, the totality of eight planar surfaces constituting a particular combination of eight card values in a defined order, as well as a particular combination of four color symbols also in a defined order, in a manner such that simultaneous throwing of all of the dice of the set makes it possible to obtain a variety of card hands including hands having a series of cards which follow one another in the order of value defined and in the same color symbol and hands having a series of cards which follow in the order defined in color symbols which are systematically different.

3. A set of dice according to claim 2, wherein said set comprises from two to seven dice marked with values and color symbols of a set of fifty-two playing cards, the values and color symbols marked on the set of dice being equal to eight times the number of dice of the set, in the order of defined value of the cards, and further wherein each die of the set comprises two blocks of four card values which follow in the order of defined value, the first card value of the second block being obtained by counting a number of card values equal to the number of dice in the set from the first card value of the first block, and wherein each first card value in each first block of each die follows in the order of defined value the first card value of a first card value of a first block of a preceding die.

4. A set of dice according to claim 3, wherein to each of the eight card values on each die are applied one of the four suits associated with a deck of playing cards in a defined order according to said order of defined value.

5. A set of dice according to claim 4, wherein the order of application of the suits alternates successively between a black color and a red color and from suit to suit, and wherein the card values are positioned on said planar faces in a manner such that the first card value of the first block is opposite the fourth card value of the second block, the second card value of the first block is opposite the third card value of the second block, the third card value of the first block is opposite the second card value of the second block, and the fourth card value of the first block is opposite the first card value of the second block, card values are positioned on each die in a manner such that two consecutive card values are not on faces having a common edge, and four card values of the same color on each die are grouped around a single convex face which allows for the printing of the die by stamping in two passes.

6. A die comprising eight planar surfaces and six convex faces, said planar surfaces comprising substantially hexagonal faces; said substantially hexagonal faces being grouped in a first block and a second block, with each of said first block and said second block containing four substantially hexagonal faces; each of said substantially hexagonal faces has two sides in common with two other substantially hexagonal faces in each of said first block and said second block in order to thereby define, in each of said first block and said second block, four common edges and a substantially pyramidal shaped having a base including a third side of each of said substantially hexagonal faces; said first block and said second block being positioned relative to one another so that the base defined by said first block is coextensive bases form four common edges; sides of each of said substantially hexagonal faces that are not in common with sides of the other substantially hexagonal faces forming six zones; said six convex faces being positioned so that each of said six zones includes one of said six convex faces; and each of said six convex faces being dimensioned so as to constitute areas of unstable equilibrium to favor positioning of the die on one of said substantially hexagonal faces, wherein each side of each of said substantially hexagonal faces has a length substantially A, and said convex faces are a portion of a sphere having a radius of approximately said length A.

7. A die comprising eight planar surfaces and six convex faces, said planar surfaces comprising substantially hexagonal faces; said substantially hexagonal faces being grouped in a first block and a second block, with each of said first block and said second block containing four substantially hexagonal faces; each of said substantially hexagonal faces has two sides in common with two other substantially hexagonal faces in each of said first block and said second block in order to thereby define, in each of said first block and said second block, four common edges and a substantially pyramidal shape having a base including a third side of each of said substantially hexagonal faces; said first block and said second block being positioned relative to one another so that the base defined by said first block is coextensive with the base defined by said second block, and the third sides or each of said substantially hexagonal faces in the two coextensive bases form four common edges; sides of each of said substantially hexagonal faces that are not in common with sides of the other substantially hexagonal faces forming six zones; said six convex faces being positioned so that each of said six zones includes one of said six convex faces; and each of said six convex faces being dimensioned so as to constitute areas of unstable equilibrium to favor positioning of the die on one of said substantially hexagonal faces, wherein said convex faces have surfaces that are substantially tangent to each of said common edges, further wherein each side of each of said hexagonal faces has a length substantially A, and said convex faces are a portion of a sphere having a radius of approximately said length A.

8. A die comprising eight planar surfaces and six convex faces, said planar surfaces comprising substantially hexagonal faces; said substantially hexagonal faces being grouped in a first block and a second block, with each of said first block and said second block containing four substantially hexagonal faces; each of said substantially hexagonal faces has two sides in common with two other substantially hexagonal faces in each of said first block and said second block in order to thereby define, in each of said first block and said second block, four common edges and a substantially pyramidal shape having a base including a third side of each of said substantially hexagonal faces; said first block and said second block being positioned relative to one another so that the base defined by said first block is coextensive with the base defined by said second block, and the third sides of each of said substantially hexagonal faces in the two coextensive bases form four common edges; sides of each other of said substantially hexagonal faces that are not in common with sides of the other substantially hexagonal faces forming six zones; said six convex faces being positioned so that each of said six zones includes one of said six convex faces; and each of said six convex faces being dimensioned so as to constitute areas of unstable equilibrium to favor positioning of the die on one of said substantially hexagonal faces, wherein apices are defined by end portions of said common edges, and said convex faces extend past an imaginary sphere that has as its center a center of symmetry O of the die and a surface that passes through said apices.

9. The die according to claim 8, wherein each side of each of said hexagonal faces has a length substantially A, and the radius of said imaginary sphere is about 1.581(A).

10. A set of die comprising a plurality of dice, with each die of the set comprising eight planar faces and six convex faces, said planar surfaces comprising substantially hexagonal faces; said substantially hexagonal faces being grouped in a first block and a second block, with each of said first block and said second block containing four substantially hexagonal faces; each of said substantially hexagonal faces has two sides in common with two other substantially hexagonal faces in each of said first block and second block in order to thereby define, in each of said first block and said second block, four common edges and a substantially pyramidal shape having a base including a third side of each of said substantially hexagonal faces; said first block and said second block being positioned relative to one another so that the base defined by said first block is coextensive with the base defined by said second block, and the third sides of each of said substantially hexagonal faces in the two coextensive bases form four common edges; sides of each of said substantially hexagonal faces that are not in common with sides of the other substantially hexagonal faces forming six zones; said six convex faces being positioned so that each of said six zones includes one of said six convex faces; and each of said six convex faces being dimensioned so as to constitute areas of unstable equilibrium to favor positioning of the die on one of said substantially hexagonal faces, wherein each side of each of said substantially hexagonal faces has a length substantially A, and said convex faces are a portion of a sphere having a radius of approximately said length A.

11. A set of dice comprising a plurality of dice, with each die of the set comprising eight planar faces and six convex faces, said planar surfaces comprising substantially hexagonal faces; said substantially hexagonal faces being grouped in a first block and a second block, with each of said first block and said second block containing four substantially hexagonal faces; each of said substantially hexagonal faces has two sides in common with two other substantially hexagonal faces in each of said first block and second block in order to thereby define, in each of said first block and said second block, four common edges and a substantially pyramidal shape having a base including a third side of each of said substantially hexagonal faces; said first block and said second block being positioned relative to one another so that the base defined by said first block is coextensive with the base defined by said second block, and the third sides of each of said substantially hexagonal faces in the two coextensive bases form four common edges; sides of each of said substantially hexagonal faces that are not in common with sides of the other substantially hexagonal faces forming six zones; said six convex faces being positioned so that each of said six zones includes one of said six convex faces; and each of said six convex faces being dimensioned so as to constitute areas of unstable equilibrium to favor positioning of the die on one of said substantially hexagonal faces, wherein each die includes markings, further wherein apices are defined by end portions of said common edges, and said convex faces extend past an imaginary sphere that has as its center a center of symmetry O of the die and passes through said apices.

12. The set of dice according to claim 11, wherein each side of each of said hexagonal faces has a length substantially A, and the radius of said imaginary sphere is about 1.581(A).

13. A process for producing a die having eight planar faces having sides of substantially a length A and six convex faces comprising providing a sphere having a center of symmetry O; machining a first set of substantially parallel planar surfaces on both sides of the center of symmetry; machining a second set of substantially planar surfaces, on both sides of the center of symmetry, at an angle to the first set of substantially parallel planar surfaces forming two intersecting edges; rotating the sphere substantially 90° around an axis that passes substantially through the center of symmetry and is substantially perpendicular to a plane passing through said two intersecting edges; machining a third set of substantially parallel planar surfaces on both sides of the center of symmetry; and machining a fourth set of substantially planar surfaces, on both sides of the center of symmetry, at an angle to the third set of substantially parallel planar surfaces; and forming six convex faces at apices formed between the four sets of planar surfaces to thereby obtain a die having eight planar faces and six convex faces; and said convex faces being dimensioned so as to constitute areas of unstable equilibrium to favor positioning of the die on one of the planar faces.

14. The process according to claim 13, wherein the parallel planar surfaces in each set of parallel planar surfaces is spaced apart approximately 2.446(A).

15. The process according to claim 14, wherein the angle between the first and second sets of substantially parallel planar surfaces and the third and fourth sets of substantially parallel planar surfaces is about 109.39°.

16. The process according to claim 15, wherein the sphere has a radius of at least 1.707(A).

17. A process according to claim 16, further comprising marking the die.

18. A process according to claim 17, wherein the markings comprise card values and suits of a deck of playing cards.

19. A process according to claim 18, wherein the markings are stamped onto the die in two passes.

20. The process according to claim 14, wherein the sphere has a radius of at least 1.707(A).

21. A product produced by the process of claim 15.

22. A product produced by the process of claim 16.

23. A product produced by the process of claim 17.

24. A product produced by the process of claim 18.

25. The process according to claim 13, wherein the angle between the first and second sets of substantially parallel planar surfaces and the third and fourth sets of substantially parallel planar surfaces is about 109.39°.

26. The process according to claim 13, wherein the sphere has a radius of at least 1.707(A).

27. A process according to claim 13, further comprising marking the die.

28. A product produced by the process of claim 13.

* * * * *